US006325597B1

(12) United States Patent
Kim et al.

(10) Patent No.: US 6,325,597 B1
(45) Date of Patent: Dec. 4, 2001

(54) AXIAL FLOW FAN FOR AIR CONDITIONER

(75) Inventors: Wan Soo Kim; Sim Won Chin; Seung Chul Park, all of Kwangmyung; Dong Soo Moon, Seoul, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/475,236

(22) Filed: Dec. 30, 1999

(30) Foreign Application Priority Data

Sep. 7, 1999 (KR) ..... 11-37837
Sep. 20, 1999 (KR) ..... 11-40416

(51) Int. Cl.[7] ..... F04D 29/38

(52) U.S. Cl. ..... 416/238; 416/243; 416/DIG. 2; 416/DIG. 5; 416/242

(58) Field of Search ..... 416/242, 243, 416/DIG. 2, DIG. 5, 238

(56) References Cited

U.S. PATENT DOCUMENTS 5,961,289 * 10/1999 Lohmann ..... 416/189
6,113,353 * 9/2000 Sato et al. ..... 416/232
6,116,856 * 9/2000 Karadgy et al. ..... 416/203

* cited by examiner

*Primary Examiner*—Edward K. Look
*Assistant Examiner*—Ninh Nguyen
(74) *Attorney, Agent, or Firm*—Birch, Stewart, Kolasch & Birch, LLP

(57) ABSTRACT

An axial flow fan for an air conditioner is disclosed. This axial flow fan is capable of changing the shape of blades by varying a design factor such as a chord length, a sweep angle, etc., generating an enough flowing amount of a fan for implementing an efficient heat radiation of a heat exchanger, and decreasing a noise which occurs during an air flowing operation of the fan, so that it is possible to implement a high efficiency and low noise fan system. The above-described axial flow fan according to the present invention includes a hub engaged to a rotary shaft of a motor, and a plurality of blades engaged to the hub, wherein assuming a coordinate which is obtained by computing a distance R in a radial direction of the blade into a distance from a radius Rh to a radius Rt at a blade tip BT based on a non-dimensional method as "r" (r=(R−Rh)/(Rt−Rh), a maximum camber ratio Hc(r) which is a ratio between a maximum camber Cmax and a chord length 1 has 0.02±0.01 at a hub BH of r=0, 0.04±0.015 at a blade tip BT of r=1, and a maximum camber ratio at a portion of r=0.6~0.75 has a maximum value of 0.05±0.02.

9 Claims, 6 Drawing Sheets

FIG. 10

| R (mm) | Chord (mm) | Hc(r) (%) |
|---|---|---|
| 50.5 | 94.92 | 2.00 |
| 53.5 | 99.19 | 2.21 |
| 57.0 | 103.54 | 2.41 |
| 60.5 | 107.95 | 2.61 |
| 64.0 | 112.42 | 2.80 |
| 67.5 | 116.97 | 2.98 |
| 71.0 | 121.58 | 3.15 |
| 74.5 | 126.26 | 3.31 |
| 78.0 | 131.01 | 3.47 |
| 81.5 | 135.82 | 3.62 |
| 75.0 | 140.69 | 3.76 |
| 77.5 | 156.63 | 3.89 |
| 92.0 | 150.64 | 4.02 |
| 95.5 | 155.70 | 4.14 |
| 99.0 | 160.83 | 4.25 |
| 102.5 | 166.03 | 4.35 |
| 106.0 | 171.29 | 4.45 |
| 109.5 | 176.61 | 4.54 |
| 113.0 | 181.99 | 4.62 |
| 116.5 | 187.43 | 4.69 |
| 120.0 | 192.94 | 4.76 |
| 123.5 | 198.50 | 4.81 |
| 127.0 | 204.13 | 4.86 |
| 130.5 | 209.82 | 4.90 |
| 134.0 | 215.57 | 4.94 |
| 137.5 | 221.38 | 4.97 |
| 141.0 | 227.25 | 4.98 |
| 144.5 | 233.20 | 5.00 |
| 148.0 | 239.36 | 5.00 |
| 151.5 | 245.74 | 4.99 |
| 155.0 | 252.34 | 4.97 |
| 158.5 | 259.16 | 4.94 |
| 162.0 | 266.18 | 4.89 |

| R (mm) | Chord (mm) | Hc(r) (%) |
|---|---|---|
| 165.5 | 273.43 | 4.83 |
| 169.0 | 280.88 | 4.75 |
| 172.5 | 288.54 | 4.66 |
| 176.0 | 296.41 | 4.56 |
| 179.5 | 304.49 | 4.44 |
| 173.0 | 312.77 | 4.31 |
| 176.5 | 314.13 | 4.16 |
| 190.0 | 289.85 | 4.00 |

AXIAL FLOW FAN FOR AIR CONDITIONER

BACKGROUND OF THE INVENTION

1. Field of the Invention

The present invention relates to an axial flow fan for an air conditioner, and in particular to an axial flow fan for an air conditioner which is capable of changing the shape of blades by varying a design factor such as a chord length, a sweep angle, etc., generating an enough flowing amount of a fan for implementing an efficient heat radiation of a heat exchanger, and decreasing a noise which occurs during an air flowing operation of the fan, so that it is possible to implement a high efficiency and low noise fan system.

2. Description of the Background Art

An air conditioner is an apparatus capable of processing air and supplying the processed air into a certain interior for thereby maintaining air in a room or a building in a clean state and is classified into an integration type and a separation type.

The above-described integration type and separation type air conditioners have the same functions. However, the integration type air conditioner having an integrated cooling and heating function is installed using a fixing apparatus by forming a hole at a window or a wall. In addition, in the separation type, a cooling apparatus is installed inside a room as an indoor unit, and a heat radiating and compression apparatus is installed outside the room as an outdoor unit. The cooling apparatus and the heat radiating and compression apparatus are connected by a refrigerant pipe.

The separation type air conditioner will be explained.

The separation type air conditioner includes an indoor unit for performing a cooling function, an outdoor unit for performing a heat radiating and compression function, and a refrigerant pipe for connecting the indoor and outdoor units.

The indoor unit absorbs heat in a certain interior, and the outdoor unit radiates heat, which corresponds to a sum of heat absorbed in the interior and heat that a compressor radiates to refrigerant, to the outside.

As shown in FIG. 1, the outdoor unit of the conventional separation type air conditioner includes an axial flow fan 1 for sucking an indoor air, generating a certain flow of air used for a heat exchange by the outdoor unit and discharging air, a motor 3 for providing a driving force to the axial flow fan 1, a compressor 5 for compressing a low temperature and pressure vapor state refrigerant flown from the indoor unit and changing the same into a high temperature and pressure vapor state refrigerant, an outdoor heat exchanger 7 for exchanging heat between the high temperature and pressure vapor state refrigerant and the air sucked by the axial flow fan 1 for thereby condensing the same into an ambient temperature and high pressure liquid state refrigerant, an accumulator 8 installed at a suction portion of the compressor 5 for removing an impurity of the refrigerant and preventing the liquid state refrigerant from being flown into the compressor 5, and a casing 10 for receiving the above-described elements therein.

The casing 10 includes a front panel 11 for forming a front surface of the outdoor unit, and a rear panel 13 for forming both side surface and a rear surface. The rear panel 13 includes a suction port 13*a* for sucking an external air into the interior of the casing 10, and the front panel 11 includes a discharge port 11*a* for discharging the inner air of the casing 10 to the outside.

In addition, a protection grille 12 is installed at a portion of the discharge port 11a for preventing an access of the axial flow fan 1 which is rotated at a high speed.

In the drawings, reference numeral 4 presents a shroud 4 which guides the flow of air discharged from the discharge port 11*a* of the front panel 11 by the axial flow fan 1, and reference numeral 6 represents a noise absorbing material which surrounds the compressor 5 for decreasing noises of the compressor 5.

The operation of the above-described outdoor unit will be explained.

When the refrigerant gas compressed by the compressor 5 is supplied to the outdoor heat exchanger 7, a heat exchange is performed between the supplied refrigerant and the air sucked into the interior of the casing 10 by the rotation of the axial flow fan 1 for thereby condensing the refrigerant into an ambient temperature and high pressure state refrigerant, and the temperature of the thusly sucked air is increased.

The air having the thusly increased temperature is discharged to the outside by the axial flow fan 1.

Namely, the air sucked into the interior of the casing 10 through the suction port 13*a* of the rear panel 13 of the outdoor heat exchanger 7 is discharged to the outside through the axial flow fan 1 and the discharge port 11*a* of the front panel 11.

When the compressor 5 compresses the refrigerant, the refrigerant circulates through the indoor/outdoor space connection refrigerant pipe which connects the indoor unit and the outdoor unit, so that the refrigerant is flown into the heat exchanger 7. At this time, as the axial flow fan 1 is rotated by the driving operation of the motor 3, the air is sucked through the suction port 13*a*, and a certain air flux is formed in the air discharged through the discharge port 11*a*. The thusly formed flux air contacts with the outdoor heat exchanger 7, so that the refrigerant is condensed.

The refrigerant condensed by the outdoor heat exchanger 7 is adiabatically expanded by an expander(not shown) and is supplied to the indoor unit(not shown) through the indoor/outdoor space connection refrigerant pipe(not shown).

The refrigerant supplied to the indoor unit is heat-exchanged with the air sucked by an indoor fan(not shown) in an indoor heat exchanger(not shown) and is changed into a low temperature and pressure vapor state refrigerant. At this time, the air passed through the indoor heat exchanger has a temperature dropped by a heat exchanger with the refrigerant and is flown into the indoor space for thereby implementing a cooling operation.

Continuously, the refrigerant which is changed to a low temperature and pressure vapor state by the indoor heat exchanger of the indoor unit is moved to the compressor 5 through the indoor/outdoor space connection refrigerant pipe. The above-described operation is repeatedly performed.

In detail, the refrigerant which is heat-exchanged in the indoor unit flows through the indoor/outdoor space connection refrigerant pipe and a service valve mount 14 installed at a portion of the outdoor unit and is introduced into the compressor 5 through the accumulator 8 installed for removing a certain impurity and preventing an introduction of the liquid state refrigerant.

As described above, in the operation of the outdoor unit of the air conditioner, the axial flow fan 1 which generates a certain flux in air is important.

Namely, the axial flow fan 1 is designed so that a certain air flowing amount which is required for enhancing a heat exchanging efficiency between the refrigerant and air is obtained.

In addition, in order to satisfy the need of a customer, the axial flow fan 1 must consume a small amount of electric power. The air flowing noises must be decreased.

In order to manufacture a fan which satisfies the above-described conditions, an intensive study has been conducted for changing the shape of the fan by changing various fan design factors.

There are various fan design factors which determine the shape of the fan. In addition, the effects that the above-described design factors affect the performance of the fan are complicated and various.

As shown in FIGS. 2, 4 and 5, as the fan design factors which may affect the shape of the axial flow fan 1, there are a diameter (2×Rt) of an axial flow fan, a diameter (2×Rh) of a blade hub, the number and an external dimension of blades 2, a pitch angle $\phi$ with respect to each blade 2, a maximum chamber (Cmax), a sweep angle $\theta$, a chord length (1), a rake, etc. In addition, there are a leading edge LE of a blade, a trailing edge TE, and a curvature shape of a blade tip BT.

As shown in FIG. 2, the rake among the above-described dimensions represents a degree that the position of the cross section is deviated in a ±Z direction in accordance with the radial position of the blade when viewing the cross sectional from a Z-X plane. The descriptions of the remaining dimensions will be provided as follows.

In the axial flow fan 1 in which the shape of a three-dimensional blade is determined based on the above-described fan design factors, the end portion having a radius relatively larger compared to a plurality of portions of the blade 2 is important for the reason that most flowing amount occurs at a blade tip BT of the blade.

As shown in FIG. 3, as a result of a measurement of a sound intensity at the portion behind the blade 2 of the axial flow fan 1, noises constantly occur irrespective of the radial direction of the blade 2, in particular, irrespective of the portions of the hub or the portions of the blade tip.

Therefore, a portion(hub portion) having a radius relatively smaller compared to a plurality of the portions of the blade 2 of the axial flow fan 1 does not affect an increase of the flowing amount of air. In this case, the power consumption of the motor 3 is increased, and the noises are increased. Therefore, the above-described portion(hub portion) does not affect an air flowing efficiency at a plurality of portions of the blade 2 of the axial flow fan 1 but increases a power consumption and noise occurrence. Therefore, a part of the portion having a smaller radius may be removed for thereby implementing a low noise and high efficiency of the axial flow fan 1.

Namely, the axial flow fan is installed at the outdoor unit for generating a certain air flow flux which is required for the heat exchanger. An intensive study has been performed for optimizing the shape of the axial flow fan in order to decrease the power consumption of the motor used for rotating the axial flow fan and the air flowing noises for thereby enhancing an efficiency of the axial flow fan even when the same amount of air occurs.

SUMMARY OF THE INVENTION

Accordingly, it is an object of the present invention to provide an axial flow fan for an air conditioner which is capable of generating an enough amount of air flow used for a heat exchange of a heat exchanger by optimizing a design factor of an axial flow fan installed at an outdoor unit of an air conditioner and decreasing a power consumption of a motor and a noise which occurs during an air flowing operation of an axial flow fan.

To achieve the above object, there is provided an axial flow fan for an air conditioner according to a first embodiment of the present invention which includes a hub engaged to a rotary shaft of a motor, and a plurality of blades engaged to the hub, wherein assuming a coordinate which is obtained by computing a distance R in a radial direction of the blade into a distance from a radius Rh to a radius Rt at a blade tip BT based on a non-dimensional method as "r" (r=(R−Rh)/(Rt−Rh) , a maximum camber ratio Hc(r) which is a ratio between a maximum camber Cmax and a chord length 1 has 0.02±0.01 at a hub BH of r=0, 0.04±0.015 at a blade tip ST of r=1, and a maximum camber ratio at a portion of r=0.6~0.75 has a maximum value of 0.05±0.02.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 10 is a table illustrating a variation of a maximum camber ratio based on a change of a fan blade radius of an axial flow fan and a chord length according to the present invention.

DETAILED DESCRIPTION OF THE PREFERRED EMBODIMENTS

The embodiments of the present invention will be explained with reference to the accompanying drawings.

Figure 1:
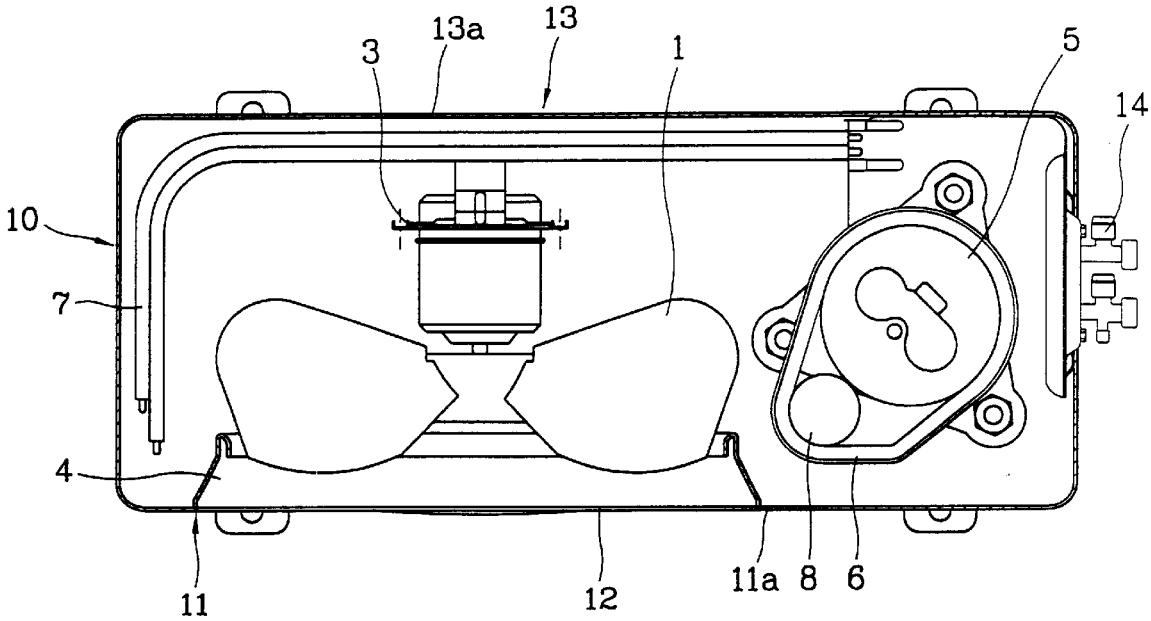
FIG. 1 CONVENTIONAL ART
FIG. 1 is a plan view illustrating an inner structure of an outdoor unit of a conventional separation type air conditioner.
Figure 2:
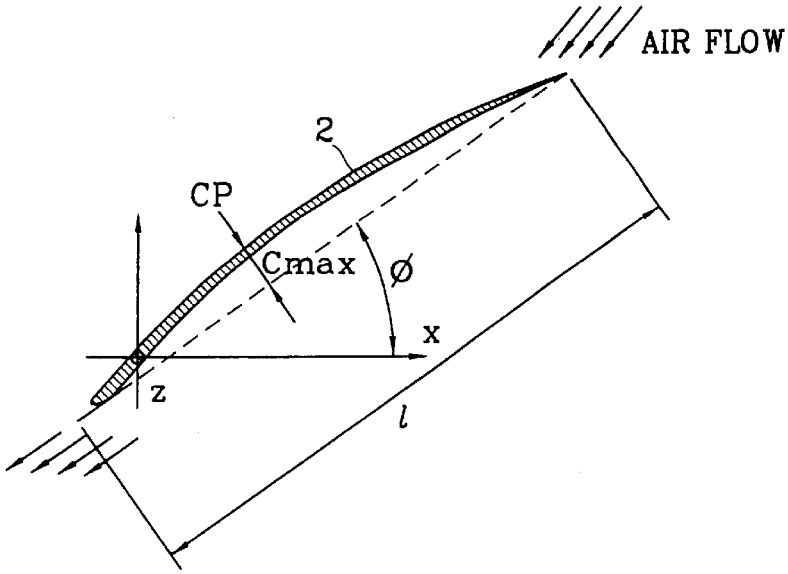
FIG. 2 CONVENTIONAL ART
FIG. 2 is a plan view illustrating a blade of a conventional axial flow fan.
Figure 3:
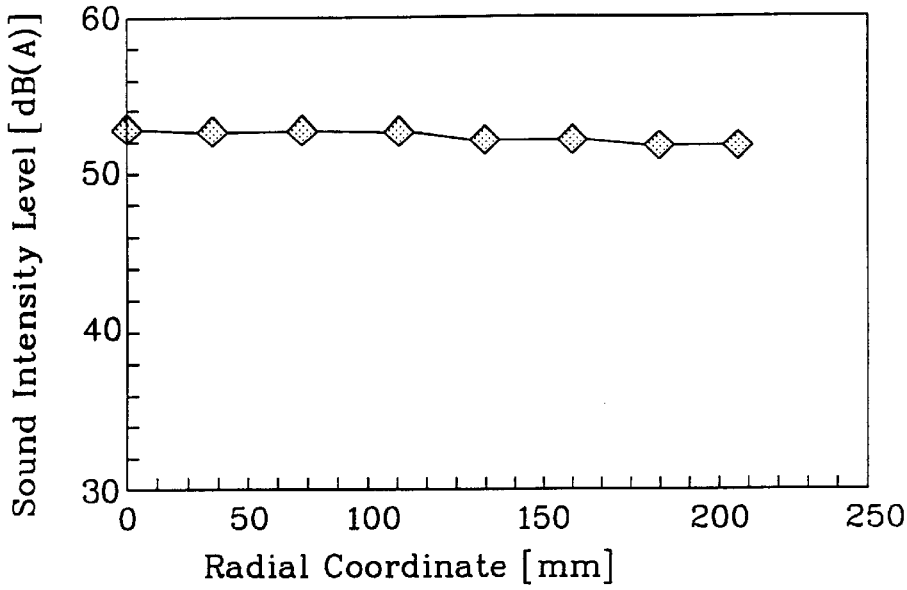
FIG. 3 CONVENTIONAL ART
FIG. 3 is a graph of a result of a measurement of a radial direction noise behind a conventional axial flow fan blade.
Figure 4:
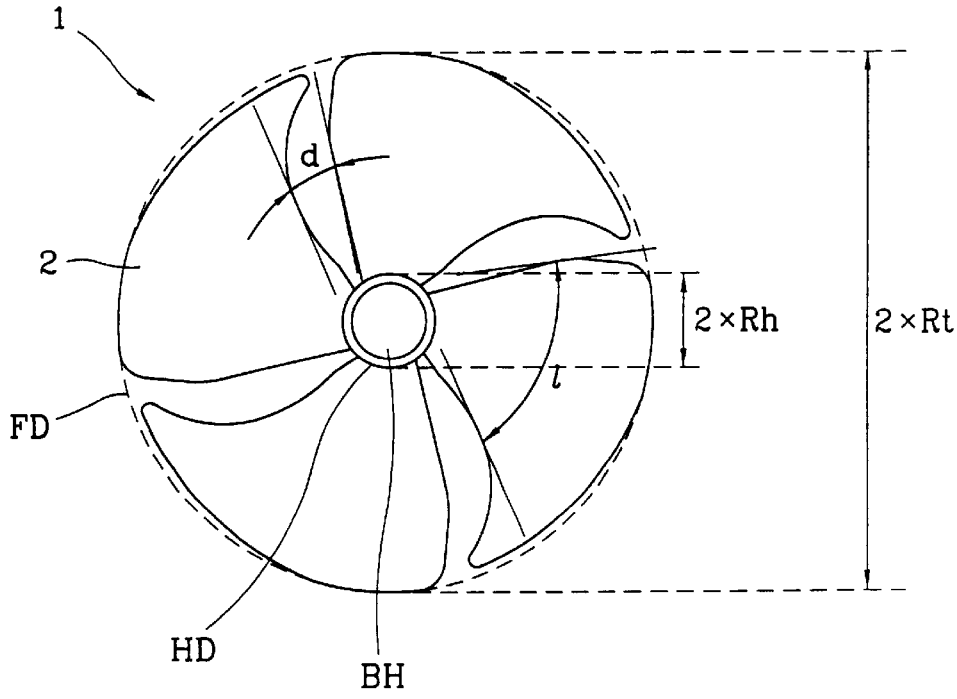
FIG. 4 is a plan view illustrating an axial flow fan for an air conditioner according to the present invention.
Figure 5:
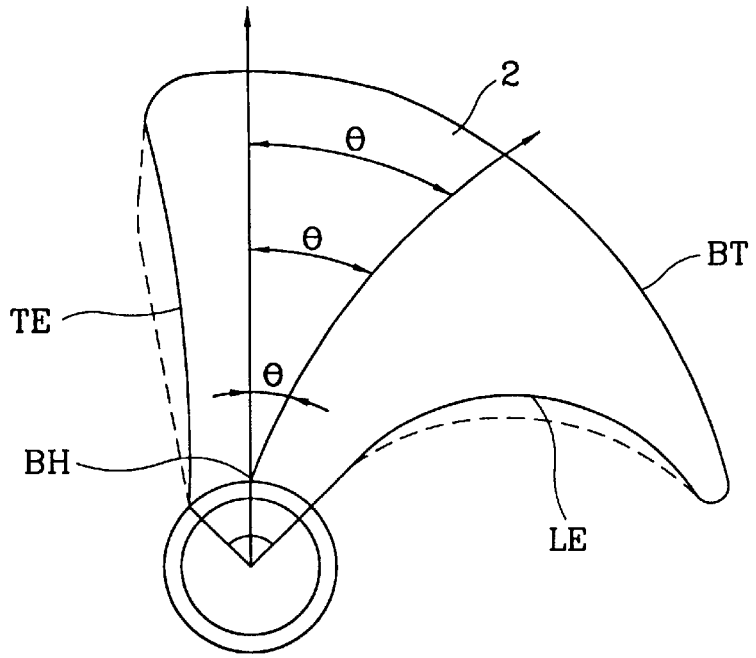
FIG. 5 is a plan view illustrating a blade of an axial flow fan according to the present invention.

As shown in FIGS. 4 and 5, an axial flow fan for an air conditioner according to the present invention includes a hub BH engaged to a rotary shaft of a motor 13, and a plurality of blades 2 installed at the hub BH. The axial flow fan according to the present invention is designed by optimizing fan design factors (as shown in FIG. 2) such as a fan diameter FD, a hub diameter HD, the number of blades 2, a maximum camber position CP, a sweep angle θ, a pitch angle ϕ, a chord length 1, a distance d between the blades for thereby increasing an efficiency of the axial flow fan.

In the axial flow fan for an air conditioner according to the present invention, a fan diameter FD is 380±2 mm or 400±2 mm, a hub diameter HD is 100±2 mm, and the number of the blades 2 is four(4).

In addition, the maximum camber position CP of the blade 2 is positioned at a portion of 0.7±0.02 of the chord length 1 from the leading edge LE to the direction of the trailing edge TE and is formed in a curve from the blade hub BH to the blade tip BT.

Here, the leading edge LE represents a front end portion in a direction that the fan is rotated, and the trailing edge TE represents a rear end portion in a direction that the fan is rotated. The chord length 1 represents a straight distance between the leading edge LE and the trailing edge TE. The maximum camber position Cp represents a position where the upper surface of the blade 2 is farthest in a vertical direction from an imaginary chord line 1 between the leading edge LE and the trailing edge TE, and the maximum camber Cmax represents a vertical distance from the maximum position to the imaginary chord line 1 between the leading edge LE and the trailing edge TE.

In addition, the maximum camber ratio which is a ratio of the maximum camber Cmax and the chord length 1 is distributed in a combined type of two parabolas. Assuming that a coordinate that the distance R in the radial direction of the blade 2 is processed based on a non-dimensional method using a distance from the radius Rh of the hub BH to the radius Rt of the blade tip BT is r, wherein, in the non-dimensional method, the hub is indicated as 0, and the tip is set to 1, and the distance between the hub and the tip is indicated as a positive numeral smaller than 1 in proportional to the distance spaced-apart from the hub BH, in the present invention, the maximum camber ratio is determined to have 0.02±0.01 at the hub PH at r=0, 0.04±0.015 at the blade tip BT at r=1, and 0.05±0.02 at the portion of r=0.6~0.75.

Here, "r" is computed based on (R−Rh)/(Rt−Rh). Rh is subtracted from the denominator and the numerator for the reason that the portion at r=0 is not determined as the center of the hub but an outer circumferential surface of the hub.

However, the values are indicated at three portions of the hub BH at r=0, the blade tip BT at r=1, and the portion in which r has the maximum camber ratio. The following equations are used for computing the values in the entire regions of r=0~1.

$$\text{Maximum camber ratio: } Hc(r)=\alpha r^2+\beta r+\gamma \qquad \text{Equation 1}$$

In the equation 1, in the case that $r<r_c$, α is $(a-b)/r_c^2$, and β is $-2\alpha r_c$, and γ is "a".

In the case that $r\geqq r_c$, $\alpha=(c-b)/(1-r_c)^2$, and $\beta=-2\alpha r_c$, and $\gamma=b-\alpha r_c^2-\beta r_c$.

As a result of a plurality of experiments, the values of a, b, c, and $r_c$ are preferably 0.02, 0.05, 0.04 and 0.7, respectively.

Figure 6:
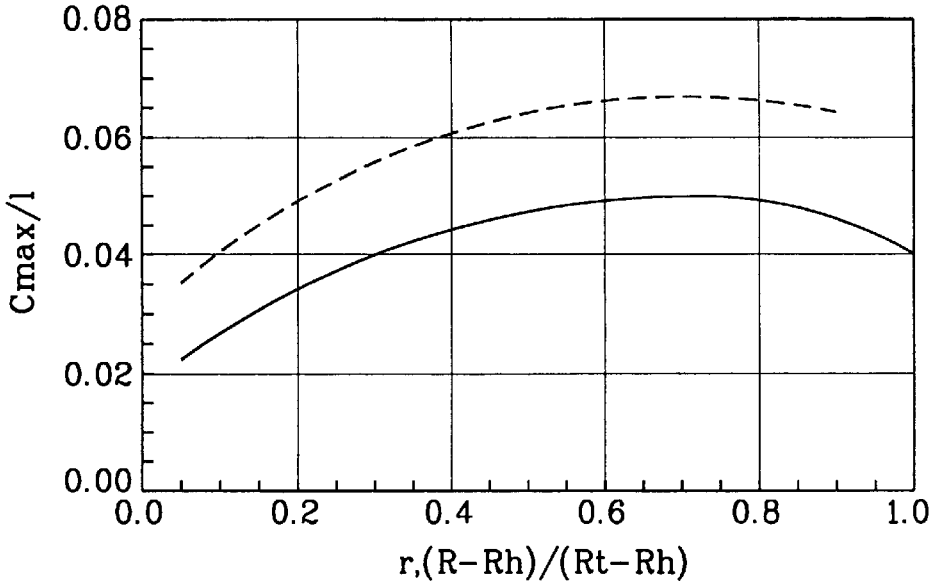
FIG. 6 is a graph of a comparison of a maximum camber ratio with respect to a coordinate value which is obtained by processing a distance of a fan blade of an axial flow fan in a radius direction based on a distance between a hub radius and a radius of an end portion of a fan blade between the present invention and a conventional art.
Figure 8:
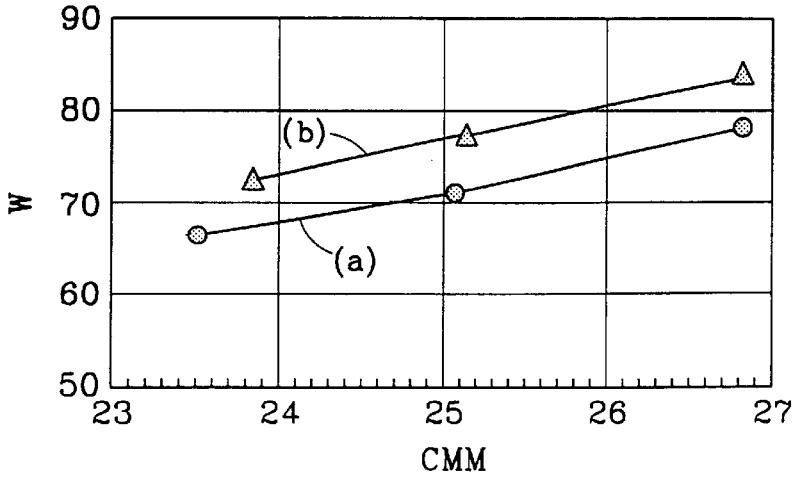
FIG. 8 is a graph illustrating an interrelationship between an air flowing amount and a power consumption of an axial flow fan between the present invention and a conventional art.

FIG. 8 illustrates a result which is obtained when adapting the values of a=0.03, b=0.07, c=0.065, and $r_c$=0.7 in the conventional art and a distribution of the maximum camber ratio in the present invention in which the above-described values are adapted. In FIG. 6, the broken line represents the conventional art, and the straight line represents the present invention.

The formation of the sweep angle will be explained.

As shown in FIG. 5, the sweep angle θ represents an angle that the line connecting the LE of the blade and an intermediate point of the TE from an outer surface of the hub BH to the blade tip BT in a state that the center of the hub BH is coincided with a vertical axis, and in particular represents a degree that the blade 2 is inclined toward the rotation direction.

In the present invention, in a region of r<0.5, the sweep angle θ of the blade 2 is 39~41°, and in a region of r≧0.5, the sweep angle is increased like a parabola, so that 46~50° of the sweep angle θ is formed at the blade tip BT.

In addition, in order to increase a fan efficiency by removing the portions of the blade 2 by which a power consumption and noise are increased without enhancing an air flowing efficiency of the fan, the center portion between the leading edge LE of the blade 2 and the trailing edge TE is formed in a concave shape in a direction that the chord length 1 of the blade 2 is decreased, so that the area of the blade is decreased.

Here, the shape of the center portion of the leading edge LE and the trailing edge TE of the blade 2 and the chord length 1 based on a variation of r may be varied and determined based on the following equations.

$$1=95+(158.2\times r^2+77\times r)\pm 2(r<0.975)$$

where in the case of r≧0.975, it is possible to implement various variations not based on a certain equation because it is difficult to form the end portions of the fan, and the durability of the fan is bad.

At this time, since the number of blades is four(4), the distance d between the blade as shown in FIG. 2 and the blade is determined based on the following equation in accordance with a variation of r.

$$d=\pi/2[r(R_t-R_h)+Rh)-[95+(158.2\times ar^2+77\times r)]+2 \text{ where } (r<0.975)$$

Figure 7:
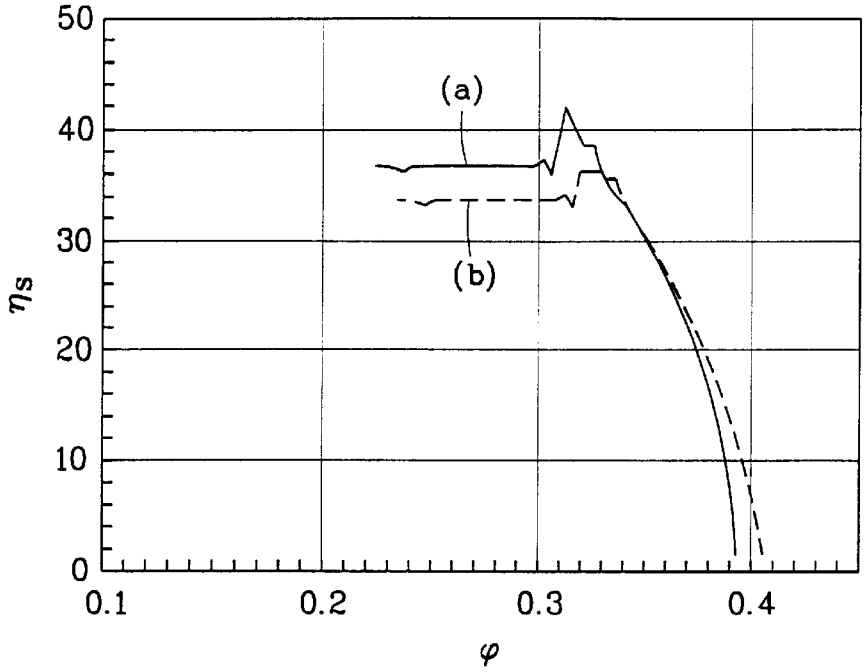
FIG. 7 is a graph illustrating an interrelationship between a flow coefficient and a static pressure efficiency of an axial flow fan between the present invention and a conventional art.

A certain experiment is performed in order to compare the performances of the axial flow fan according to the present invention and a conventional axial flow fan, so that the graphs of FIGS. 7 and 8 are obtained.

FIG. 7 illustrates a result of the experiment which is performed based on an air flowing amount coefficient ϕ which is a non-dimensional value of the air flowing amount. In FIG. 7, the line "a" represents an experimental value obtained by adapting an axial flow fan according to the present invention, and the line "b" represents an experimental value obtained by adapting a conventional axial flow fan.

The air flowing coefficient ϕ is defined as follows.

$$\varphi=\frac{4Q}{\pi^2(D_t^2-D_n^2)D_tN}$$

where Q represents an air flowing amount, $D_t$ represents a diameter of the fan, and Dn represents a diameter of the hub, and N represents a rotation angle.

In addition, FIG. 8 is a graph of an experimental result of a power consumption compared to the same air flowing amount. In FIG. 8, the line "a" represents an experimental value obtained by adapting the axial flow fan according to the present invention, and the line "b" represents an experimental value obtained by adapting a conventional axial flow fan.

Figure 9:
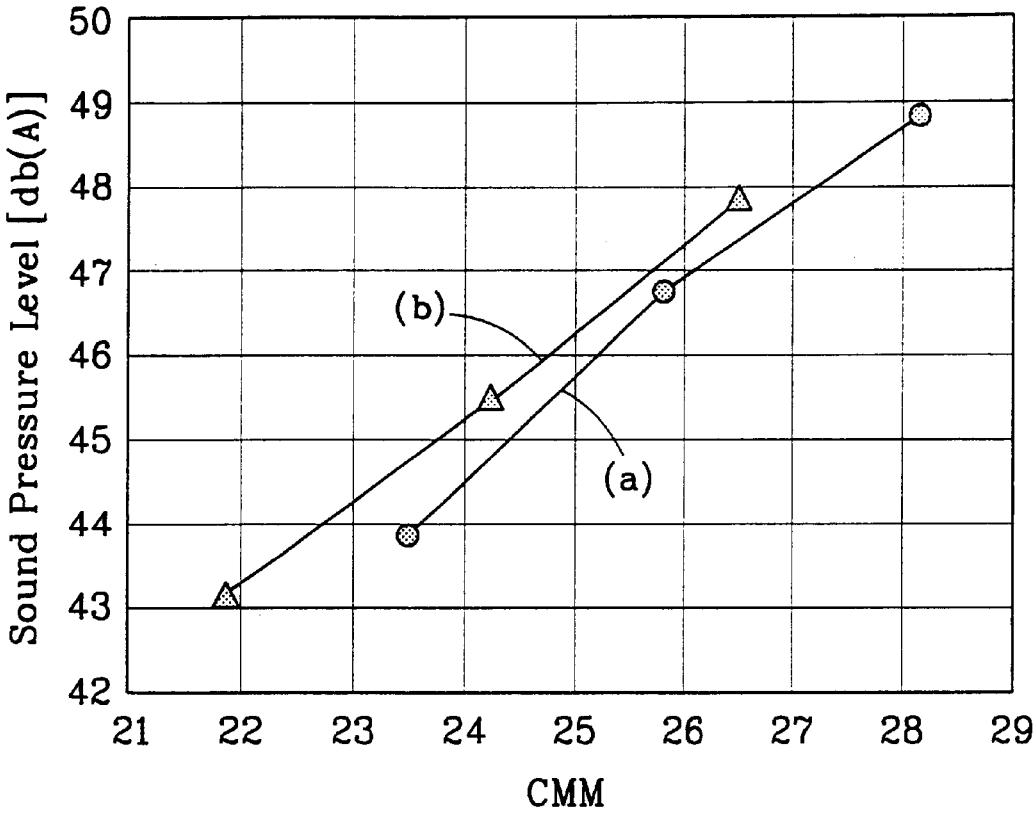
FIG. 9 is a graph illustrating an interrelationship between an air flowing amount and a noise of an axial flow fan between the present invention and a conventional art.

FIG. 9 is a graph of an experimental result of a noise compared to the same air flowing amount. In FIG. 9, the line "a" represents an experimental value obtained by adapting an axial flow fan according to the present invention, and the line "b" represents an experimental value obtained by adapting a conventional axial flow fan.

As shown in FIGS. 7 through 9, the axial flow fan according to the present invention has a good air flowing efficiency based on an enhanced static pressure efficiency($^{n}$s) In the present invention, the power consumption is decreased by about 5 W compared to the same air flowing amount between the present invention and the conventional art. In addition, the noise is decreased by about 1 dB(A) compared to the same air flowing amount.

In the above description, the case that the diameter FD of the fan was smaller than 380 mm was explained. In the case that the diameter FD of the fan is larger than 380 mm, Rt is fixed at 190 mm for the portion in which the diameter FD of the fan is 380 mm for thereby computing "r" and setting the design factors. For the portion in which the diameter FD of the fan is larger than 380 mm, the design factors of the fan are determined based on an extrapolation method.

FIG. 10 illustrates a table illustrating the radius of the fan blade of the axial flow fan according to the present invention and a variation of a maximum camber ratio based on a variation of the chord length. The values in the table are used as basic values when designing the fan.

In addition, in another embodiment of the present invention, assuming that the diameter of the axial flow fan 1 is 400 mm, the values of a=0.02, b=0.05, c=0.0364, and $r_c$=0.641 are adapted to the Equation 1 for thereby setting a maximum camber ratio.

As described above, in the axial flow fan for an air conditioner according to the present invention, the shape of the blade is changed by varying the fan design factors such as the area of the blade, and the chord length, so that it is possible to generate an enough amount of air flow for a heat exchanging operation and decrease a power consumption and noise of the motor for thereby implementing a high efficiency of the fan.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. An axial flow fan for an air conditioner, comprising:

a hub engaged to a rotary shaft of a motor; and a plurality of blades engaged to the hub, wherein assuming a coordinate which is obtained by computing a distance R in a radial direction of one of the plurality of blades into a distance from a radius Rh of the hub to a radius Rt at a blade tip based on a non-dimensional method as "r" (r=(R−Rh)/(Rt−Rh)), a maximum camber ratio Hc(r) of said blade which is a ratio between a maximum camber Cmax and a chord length 1 has a value of 0.02±0.01 at the hub of r=0, a value of 0.04±0.015 at the blade tip of r=1, and maximum camber ratio at a position along the blade radius of r=0.6~0.75 has a maximum value of 0.05±0.02.

2. The fan of claim 1, wherein assuming that a diameter BD=2Rt of the axial flow fan is 380±2 mm, a diameter HD=2Rh of the hub is 100±2 mm, and the number of the blades is 4, the maximum camber ratio Hc(r) over an entire region along the blade radius of r=0~1 is:

$$Hc(r)=\alpha r^2+\beta r+y\ ,$$

wherein, in the case where $r<r_c$, then α is $(a-b)/r_c^2$, and β is $-2\alpha r_c$, and γ is a, and in the case where $r\geqq r_c$, then $\alpha=(c-b)/(1-r_c)^2$, and $\beta=-2\alpha r_c$, and $\gamma=b-\alpha r_c^2-\beta r_c$, and in this case the values of a=0.02, b=0.05, c=0.04, and $r_c$=0.7 are adapted.

3. The fan of claim 1, wherein the position of the maximum camber Cmax of the blade is positioned at 0.7±0.02% of the chord length l in a direction from the leading edge LE to the trailing edge TE.

4. The fan of claim 1, wherein a sweep angle θ of the blade is 39~41° in a region of r<0.5 and is increased like a parabola based on an increase of r in a region of r≧0.5 and is 46–50° at the blade tip.

5. The fan of claim 1, wherein the maximum camber ratio forms a combination parabola of two parabolas based on a variation of r.

6. The fan of claim 2, wherein a variation of the chord length l based on a variation of r is set by an equation of $1=95+(158.2\times r^2+77\times r)\pm 2(r<0.975)$.

7. The fan of claim 6, wherein a variation of a distance "d" between the blades is determined based on an equation of $d=\pi/2[r(R_t-R_h)+R_h]-[95+(158.2\times ar^2+77\times 2)]\pm 2$ in r<0.975.

8. The fan of claim 1, wherein assuming that a diameter BD=2Rt of the axial flow fan is 400±2 mm, a diameter HD=2Rh of the hub is 100±2 mm, and the number of the blades is 4, the maximum camber ratio Hc(r) over an entire region along the blade radius of r=0~1 is:

$$Hc(r)=\alpha r^2+\beta r+\gamma,$$

wherein, in the case where $r<r_c$, then α is $(a-b)/r_c^2$, and β is $-2\alpha r_c$, and γ is a, and in the case where $r\geqq r_c$, then $\alpha=(c-b)/(1-r_c)^2$, and $\beta=-2r_c$, and $\gamma=b=\alpha r_c^2-\beta r_c$, and in this case the values of a=0.02, b=0.05, c=0.0364, and $r_c$=0.641 are adapted.

9. The fan of claim 1, wherein assuming that a diameter BD=2Rt of the axial flow fan is 400±2 mm, a diameter HD=2Rh of the hub is 100±2 mm, and the number of the blades is 4, the maximum camber ratio Hc(r) over an entire region along the blade radius of r=0~1 is:

$$Hc(r)=\alpha r2+\beta r+\gamma,$$

wherein, in the case where $r<r_c$, then α is $(a-b)/r_c^2$, and β is $-2\alpha r_c$, and γ is a, and in the case where $r\geqq r_c$, then $\alpha=(c-b)/(L-r_c)^2$, and $\beta=-2\alpha r_c$, and $\gamma=b-\alpha r_c^2-\beta r_c$, and the maximum camber ratio is determined by adapting the values of a=0.02, b=0.05, c=0.04, and $r_c$=0.7 at a portion in which the diameter FD of the fan is 380 mm and is determined based on an extrapolation at a portion in which the diameter FD of the fan is above 380 mm.

* * * * *